US011879675B2

(12) United States Patent
Zha et al.

(10) Patent No.: US 11,879,675 B2
(45) Date of Patent: Jan. 23, 2024

(54) COOLING SYSTEM WITH FLOODED LOW SIDE HEAT EXCHANGERS

(71) Applicant: Heatcraft Refrigeration Products LLC, Stone Mountain, GA (US)

(72) Inventors: Shitong Zha, Snellville, GA (US); Douglas Cole, Columbus, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 297 days.

(21) Appl. No.: 16/743,701

(22) Filed: Jan. 15, 2020

(65) Prior Publication Data

US 2021/0215410 A1 Jul. 15, 2021

(51) Int. Cl.

| | |
|---|---|
| ***F25B 41/20*** | (2021.01) |
| ***F25B 13/00*** | (2006.01) |
| ***F25B 1/10*** | (2006.01) |
| ***F25D 11/02*** | (2006.01) |
| ***F25B 43/00*** | (2006.01) |
| ***F25B 5/02*** | (2006.01) |
| ***F25B 49/02*** | (2006.01) |

(52) U.S. Cl.

CPC ..... *F25B 41/20* (2021.01); *F25B 1/10* (2013.01); *F25B 5/02* (2013.01); *F25B 13/00* (2013.01); *F25B 43/006* (2013.01); *F25B 49/02* (2013.01); *F25D 11/022* (2013.01); *F25B 2400/0409* (2013.01); *F25B 2400/051* (2013.01); *F25B 2400/072* (2013.01); *F25B 2600/2501* (2013.01); *F25B 2700/04* (2013.01)

(58) Field of Classification Search

CPC .... F25B 41/20; F25B 13/00; F25B 2345/002; F25B 43/006; F25D 11/022

See application file for complete search history.

(56) References Cited

U.S. PATENT DOCUMENTS 2,966,043 A * 12/1960 Ross ..... F25B 5/00 62/174
2006/0174639 A1* 8/2006 Lee ..... F25B 1/10 62/160

(Continued)

FOREIGN PATENT DOCUMENTS

DE 112006002152 T5 8/2008
GB 2440669 A 2/2008

OTHER PUBLICATIONS

European Patent Office, Extended European Search Report, Application No. 21150430.3, dated Jun. 17, 2021, 7 pages.
U.S. Appl. No. 16/716,834, filed Dec. 17, 2019, Shitong Zha.

*Primary Examiner* — Jonathan Bradford
(74) *Attorney, Agent, or Firm* — Baker Botts L.L.P.

(57) ABSTRACT

A cooling system partially floods the low temperature low side heat exchangers (e.g., freezers) in the system. An accumulator is positioned between the low temperature low side heat exchangers and the low temperature compressor. The accumulator collects the refrigerant (both liquid and vapor) from the flooded low temperature low side heat exchangers. Refrigerant discharged by the low temperature compressor is fed through the accumulator so that heat can be transferred to the refrigerant collected in the accumulator. As a result, the temperature of the refrigerant discharged by the low temperature compressor drops before that refrigerant reaches the medium temperature compressor.

17 Claims, 3 Drawing Sheets

(56) References Cited

U.S. PATENT DOCUMENTS

| | | | | |
|---|---|---|---|---|
| 2011/0005268 | A1* | 1/2011 | Oshitani | F25B 41/00 62/500 |
| 2014/0053597 | A1* | 2/2014 | Matsuura | F25B 1/10 62/510 |
| 2017/0016652 | A1* | 1/2017 | Thiessen | F25B 31/002 |
| 2017/0016659 | A1* | 1/2017 | Chen | F25B 13/00 |
| 2017/0167767 | A1* | 6/2017 | Shi | F25B 43/00 |

* cited by examiner

PRIOR ART

COOLING SYSTEM WITH FLOODED LOW SIDE HEAT EXCHANGERS

TECHNICAL FIELD

This disclosure relates generally to a cooling system.

BACKGROUND

Cooling systems may cycle a refrigerant (e.g., carbon dioxide refrigerant) to cool various spaces.

SUMMARY

Cooling systems may cycle a refrigerant (e.g., carbon dioxide refrigerant) to cool various spaces. One type of cooling system is a refrigeration and/or freezing system (e.g., refrigeration shelves and freezers in a grocery store). These systems typically include a medium temperature section (e.g., refrigeration shelves) and a low temperature section (e.g., freezers). The refrigerant from the low temperature section is fed into the medium temperature section to stabilize the medium temperature section (e.g., a medium temperature compressor). Some installations, however, do not include a complete medium temperature section. For example, these installations may be lacking medium temperature low side heat exchangers (e.g., refrigeration shelves). As a result, the medium temperature compressor compresses mostly refrigerant from the low temperature section. This refrigerant has a high temperature, which causes the efficiency of the medium temperature compressor to drop.

This disclosure contemplates an unconventional cooling system that floods the low temperature low side heat exchangers (e.g., freezers) in the system. An accumulator is positioned between the low temperature low side heat exchangers and the low temperature compressor. The accumulator collects the refrigerant (both liquid and vapor) from the flooded low temperature low side heat exchangers. Refrigerant discharged by the low temperature compressor is fed through the accumulator so that heat can be transferred to the refrigerant collected in the accumulator. As a result, the temperature of the refrigerant discharged by the low temperature compressor drops before that refrigerant reaches the medium temperature compressor. In this manner, the temperature of the refrigerant at the medium temperature compressor reduced, which improves the efficiency of the medium temperature compressor. Embodiments of this cooling system are described below.

According to an embodiment, a system includes a flash tank, a first low side heat exchanger, a second low side heat exchanger, an accumulator, and a first compressor. The flash tank stores refrigerant. The first low side heat exchanger uses refrigerant from the flash tank to cool a first space proximate the first low side heat exchanger. The refrigerant discharged by the first low side heat exchanger includes a liquid portion and a gaseous portion. The second low side heat exchanger uses refrigerant from the flash tank to cool a second space proximate the second low side heat exchanger. The refrigerant discharged by the second low side heat exchanger includes a liquid portion and a gaseous portion. The accumulator collects the refrigerant discharged by the first and second low side heat exchangers. The first compressor compresses the refrigerant from the accumulator. The accumulator transfers heat from the refrigerant discharged by the first compressor to the refrigerant collected by the accumulator from the first and second low side heat exchangers.

According to another embodiment, a method includes storing, by a flash tank, refrigerant and using, by a first low side heat exchanger, refrigerant from the flash tank to cool a first space proximate the first low side heat exchanger. The refrigerant discharged by the first low side heat exchanger includes a liquid portion and a gaseous portion. The method also includes using, by a second low side heat exchanger, refrigerant from the flash tank to cool a second space proximate the second low side heat exchanger. The refrigerant discharged by the second low side heat exchanger includes a liquid portion and a gaseous portion. The method further includes collecting, by an accumulator, the refrigerant discharged by the first and second low side heat exchangers, compressing, by a first compressor, the refrigerant from the accumulator, and transferring, by the accumulator, heat from the refrigerant discharged by the first compressor to the refrigerant collected by the accumulator from the first and second low side heat exchangers.

According to yet another embodiment, a system includes a first low side heat exchanger, a second low side heat exchanger, an accumulator, and a first compressor. The first low side heat exchanger uses refrigerant to cool a first space proximate the first low side heat exchanger. The refrigerant discharged by the first low side heat exchanger includes a liquid portion and a gaseous portion. The second low side heat exchanger uses refrigerant to cool a second space proximate the second low side heat exchanger. The refrigerant discharged by the second low side heat exchanger includes a liquid portion and a gaseous portion. The accumulator collects the refrigerant discharged by the first and second low side heat exchangers. The first compressor compresses the refrigerant from the accumulator. The accumulator transferS heat from the refrigerant discharged by the first compressor to the refrigerant collected by the accumulator from the first and second low side heat exchangers.

Certain embodiments provide one or more technical advantages. For example, an embodiment transfers heat from refrigerant from a low temperature compressor to refrigerant discharged by low temperature low side heat exchangers to reduce the temperature of the refrigerant from the low temperature compressor before that refrigerant reaches a medium temperature compressor. As a result, the efficiency of the medium temperature compressor improves. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
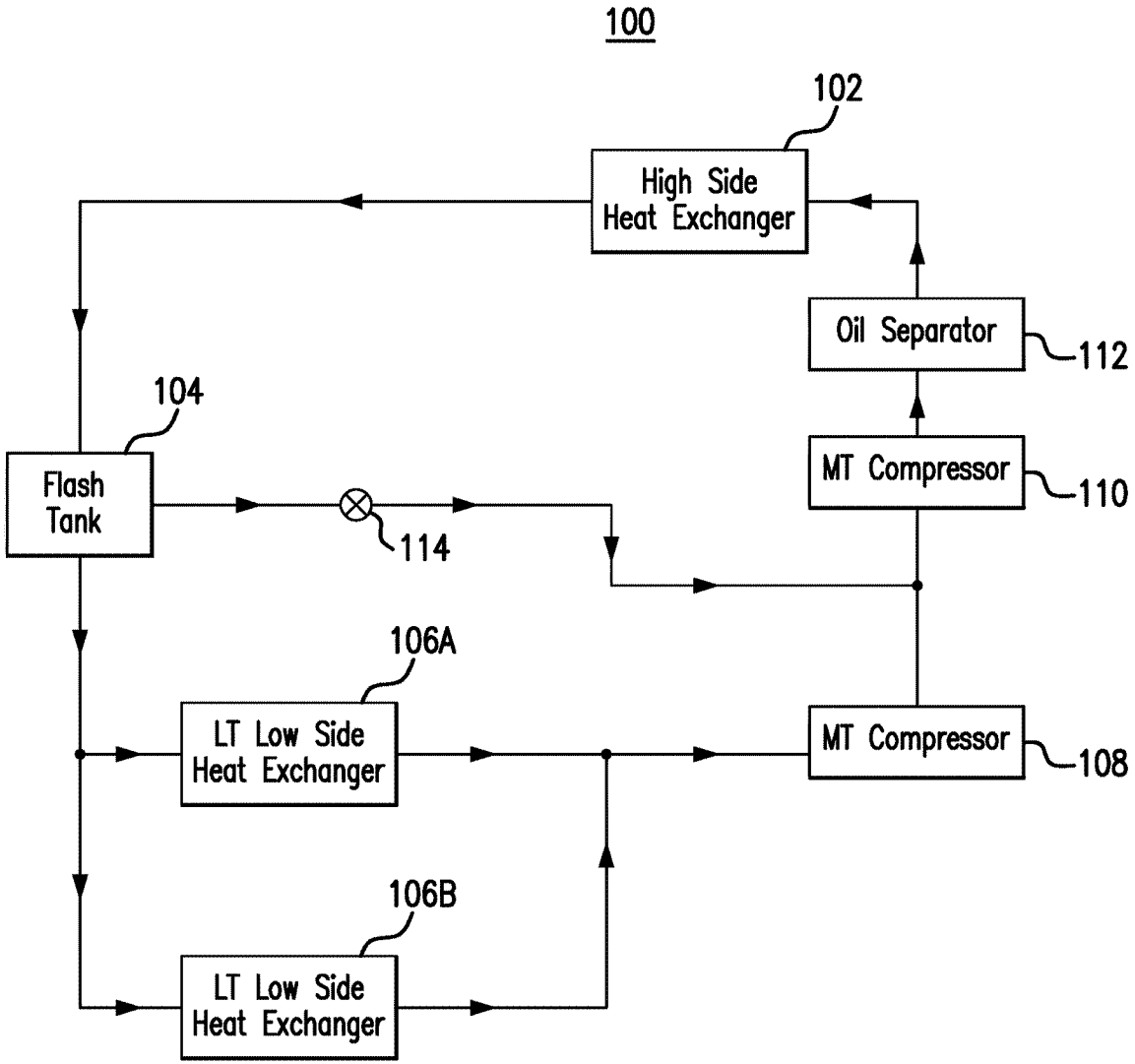
FIG. 1 illustrates an example cooling system.
Figure 2:
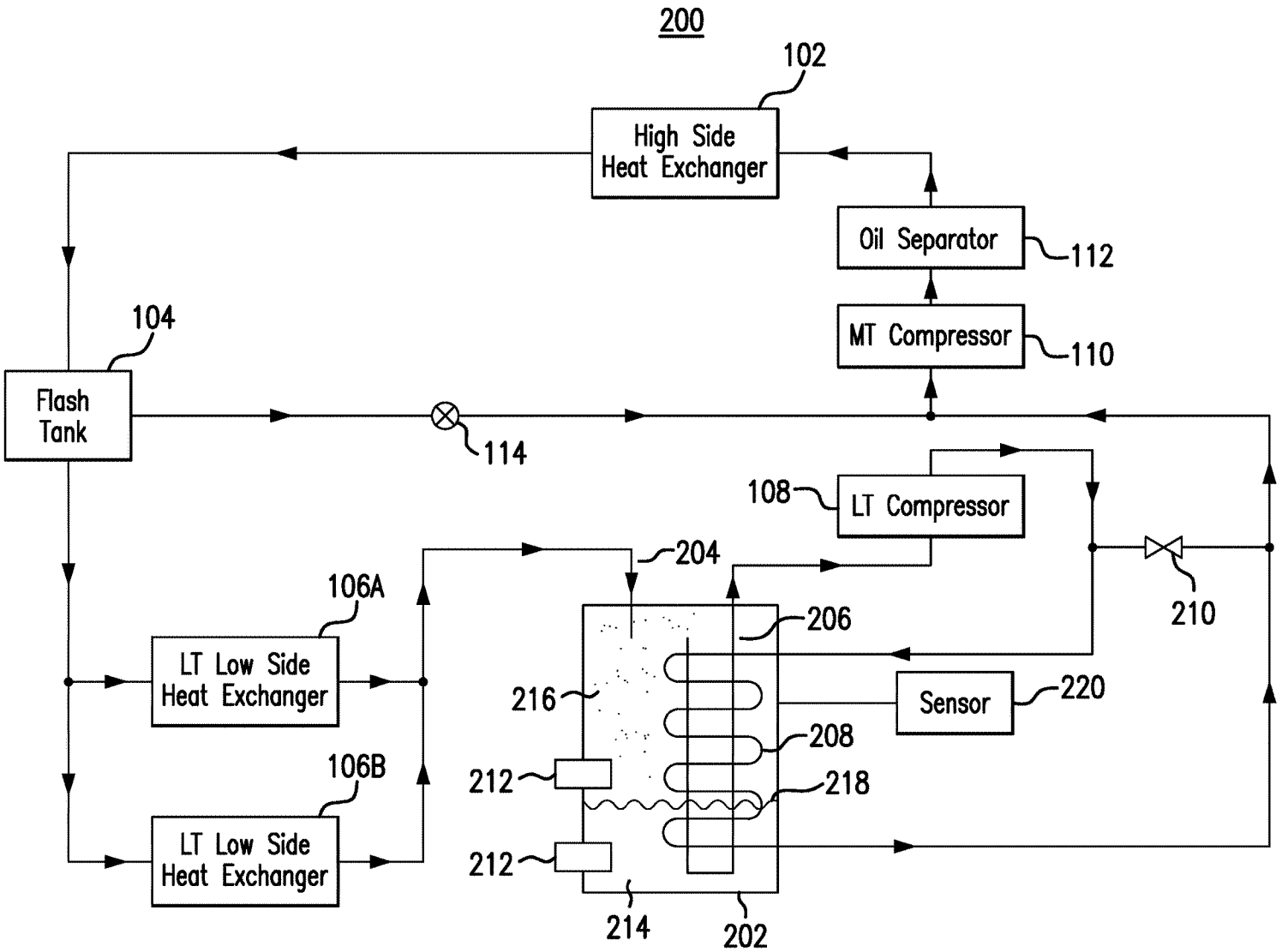
FIG. 2 illustrates an example cooling system.
Figure 3:
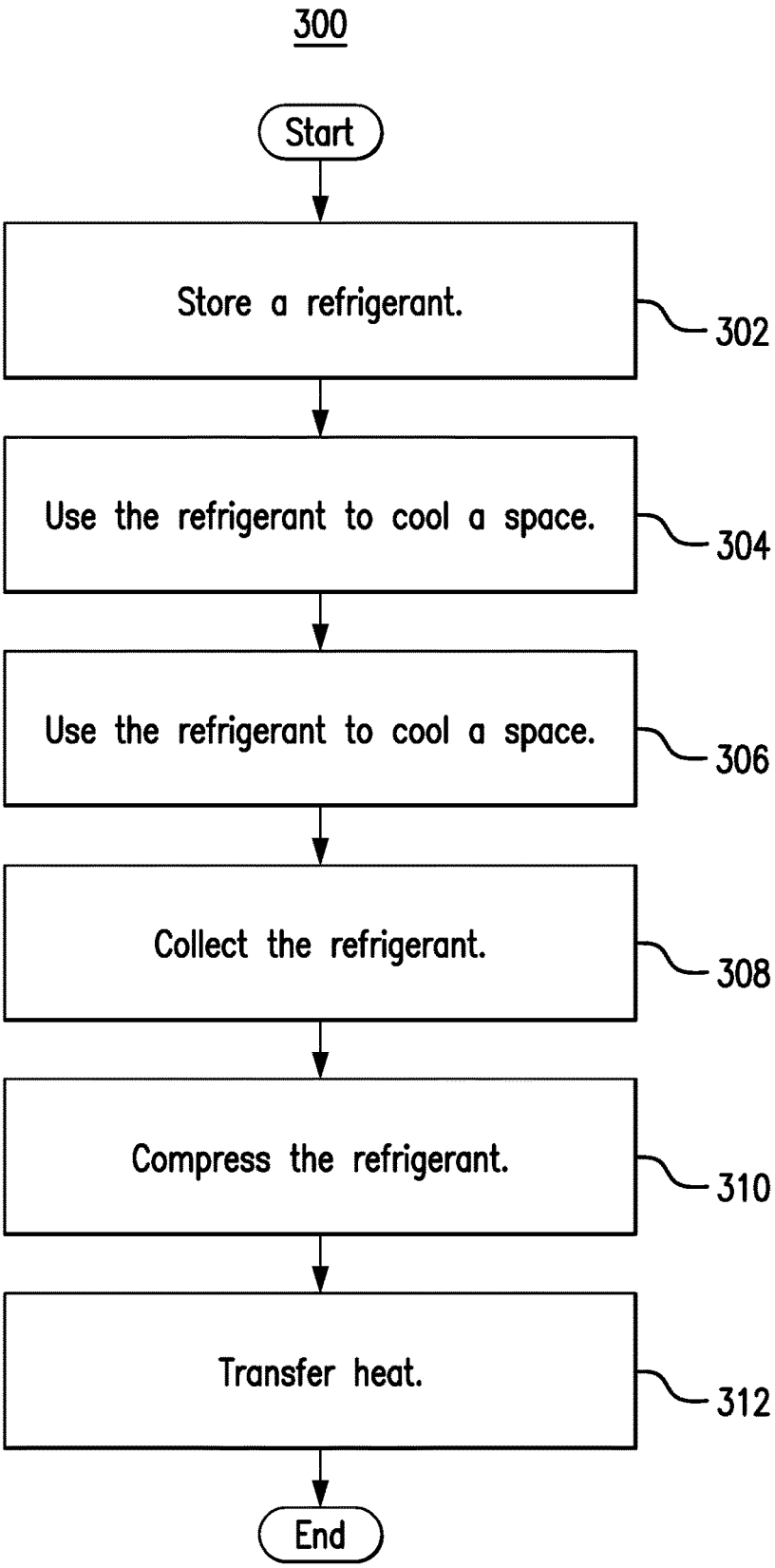
FIG. 3 is a flowchart illustrating a method of operating the example cooling system of FIG. 2.

Embodiments of the present disclosure and its advantages are best understood by referring to FIGS. 1 through 3 of the drawings, like numerals being used for like and corresponding parts of the various drawings.

Cooling systems may cycle a refrigerant (e.g., carbon dioxide refrigerant) to cool various spaces. One type of cooling system is a refrigeration and/or freezing system (e.g., refrigeration shelves and freezers in a grocery store). These systems typically include a medium temperature section (e.g., refrigeration shelves) and a low temperature section (e.g., freezers). The refrigerant from the low temperature section is fed into the medium temperature section to stabilize the medium temperature section (e.g., a medium temperature compressor). Some installations, however, do not include a complete medium temperature section. For example, these installations may be lacking medium temperature low side heat exchangers (e.g., refrigeration shelves). As a result, the medium temperature compressor compresses mostly refrigerant from the low temperature section. This refrigerant has a high temperature, which causes the efficiency of the medium temperature compressor to drop.

This disclosure contemplates an unconventional cooling system that floods the low temperature low side heat exchangers (e.g., freezers) in the system. An accumulator is positioned between the low temperature low side heat exchangers and the low temperature compressor. The accumulator collects the refrigerant (both liquid and vapor) from the flooded low temperature low side heat exchangers. Refrigerant discharged by the low temperature compressor is fed through the accumulator so that heat can be transferred to the refrigerant collected in the accumulator. As a result, the temperature of the refrigerant discharged by the low temperature compressor drops before that refrigerant reaches the medium temperature compressor. In this manner, the temperature of the refrigerant at the medium temperature compressor is reduced, which improves the efficiency of the medium temperature compressor. The cooling system will be described using FIGS. 1 through 3. FIG. 1 will describe an existing cooling system. FIGS. 2-3 describe the cooling system that floods low temperature low side heat exchangers.

FIG. 1 illustrates an example cooling system 100. As shown in FIG. 1, system 100 includes a high side heat exchanger 102, a flash tank 104, low temperature low side heat exchangers 106A and 106B, a low temperature compressor 108, a medium temperature compressor 110, an oil separator 112, and a valve 114. Generally, system 100 cycles a refrigerant to cool spaces proximate the low side heat exchangers 106A and 106B. Cooling system 100 or any cooling system described herein may include any number of low side heat exchangers.

High side heat exchanger 102 removes heat from a refrigerant. When heat is removed from the refrigerant, the refrigerant is cooled. High side heat exchanger 102 may be operated as a condenser and/or a gas cooler. When operating as a condenser, high side heat exchanger 102 cools the refrigerant such that the state of the refrigerant changes from a gas to a liquid. When operating as a gas cooler, high side heat exchanger 102 cools gaseous refrigerant and the refrigerant remains a gas. In certain configurations, high side heat exchanger 102 is positioned such that heat removed from the refrigerant may be discharged into the air. For example, high side heat exchanger 102 may be positioned on a rooftop so that heat removed from the refrigerant may be discharged into the air. As another example, high side heat exchanger 102 may be positioned external to a building and/or on the side of a building. This disclosure contemplates any suitable refrigerant (e.g., carbon dioxide) being used in any of the disclosed cooling systems.

Flash tank 104 stores refrigerant received from high side heat exchanger 102. This disclosure contemplates flash tank 104 storing refrigerant in any state such as, for example, a liquid state and/or a gaseous state. Refrigerant leaving flash tank 104 is fed to low temperature low side heat exchanger 106 and medium temperature low side heat exchanger 108. In some embodiments, a flash gas and/or a gaseous refrigerant is released from flash tank 104. By releasing flash gas, the pressure within flash tank 104 may be reduced.

System 100 includes a low temperature portion and a medium temperature portion. The low temperature portion operates at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. Refrigerant flows from flash tank 104 to both the low temperature and medium temperature portions of the refrigeration system. For example, the refrigerant flows to low temperature low side heat exchangers 106A and 106B and medium temperature compressor 110.

When the refrigerant reaches low temperature low side heat exchangers 106A and 106B, the refrigerant removes heat from the air around low temperature low side heat exchangers 106A and 106B. For example, the refrigerant cools metallic components (e.g., metallic coils, plates, and/or tubes) of low temperature low side heat exchangers 106A and 106B as the refrigerant passes through low temperature low side heat exchangers 106A and 106B. These metallic components may then cool the air around them. The cooled air may then be circulated such as, for example, by a fan to cool a space such as, for example, a freezer and/or a refrigerated shelf. As refrigerant passes through low temperature low side heat exchangers 106A and 106B, the refrigerant may change from a liquid state to a gaseous state as it absorbs heat. Any number of low temperature low side heat exchangers 106 may be included in any of the disclosed cooling systems.

Refrigerant flows from low temperature low side heat exchangers 106A and 106B to compressors 108 and 110. The disclosed cooling systems may include any number of low temperature compressors 108 and medium temperature compressors 110. Both the low temperature compressor 108 and medium temperature compressor 110 compress refrigerant to increase the pressure of the refrigerant. As a result, the heat in the refrigerant may become concentrated and the refrigerant may become a high-pressure gas. Low temperature compressor 108 compresses refrigerant from low temperature low side heat exchangers 106A and 106B and sends the compressed refrigerant to medium temperature compressor 110. Medium temperature compressor 110 compresses the refrigerant from low temperature compressor 110.

Oil separator 112 separates an oil from the refrigerant before the refrigerant enters high side heat exchanger 102. The oil may be introduced by certain components of system 100, such as low temperature compressor 108 and/or medium temperature compressor 110. By separating out the oil, the efficiency of high side heat exchanger 102 is maintained. If oil separator 112 is not present, then the oil may clog high side heat exchanger 102 and/or low temperature low side heat exchangers 106A and 106B, which may reduce the heat transfer efficiency of system 100, high side heat exchanger 102, and/or low temperature low side heat exchangers 106A and 106B.

Valve 114 controls a flow of flash gas from flash tank 104. When valve 114 is closed, flash tank 104 may not discharge flash gas through valve 114. When valve 114 is opened, flash tank 104 may discharge flash gas through valve 114. In this manner, valve 114 may also control an internal pressure of flash tank 104. Valve 114 directs flash gas to medium temperature compressor 110. Medium temperature compressor 110 compresses the flash gas along with refrigerant from low temperature compressor 108. Valve 114 may also be referred to as a flash gas bypass valve.

As seen in FIG. 1, system 100 does not include medium temperature low side heat exchangers (e.g., refrigerated shelves in a grocery setting). These medium temperature low side heat exchangers typically discharge a refrigerant that mixes with and cools the refrigerant from low temperature compressor 108 before that refrigerant reaches medium temperature compressor 110. Due to their absence from system 100, the refrigerant that reaches medium temperature compressor 110 includes mostly the hot refrigerant from low temperature compressor 108. The increased temperature of the refrigerant reaching medium temperature compressor 110 results in a degradation of the efficiency of medium temperature compressor 110.

This disclosure contemplates an unconventional cooling system that floods low temperature low side heat exchangers 106A and 106B (e.g., freezers) in system 100. An accumulator is positioned between low temperature low side heat exchangers 106A and 106B and low temperature compressor 108. The accumulator collects the refrigerant (both liquid and vapor) from the flooded low temperature low side heat exchangers 106A and 106B. Refrigerant discharged by low temperature compressor 108 is fed through the accumulator so that heat can be transferred to the refrigerant collected in the accumulator. As a result, the temperature of the refrigerant discharged by low temperature compressor 108 drops before that refrigerant reaches medium temperature compressor 110. In this manner, the temperature of the refrigerant at medium temperature compressor 110 is reduced, which improves the efficiency of medium temperature compressor 110. Embodiments of the cooling system are described below using FIGS. 2-3. These figures illustrate embodiments that include a certain number of low side heat exchangers and compressors for clarity and readability. These embodiments may include any suitable number of low side heat exchangers and compressors.

FIG. 2 illustrates an example cooling system 200. As seen in FIG. 2, system 200 includes a high side heat exchanger 102, a flash tank 104, low temperature load side heat exchangers 106A and 106B, a low temperature compressor 108, a medium temperature compressor 110, an oil separator 112, a valve 114, an accumulator 202, and a valve 210. Generally, system 200 floods low temperature low side heat exchanger 106A and 106B such that the discharge from low temperature low side heat exchangers 106A and 106B include a liquid portion and a vapor portion. Accumulator 202 collects the refrigerant discharged from low temperature low side heat exchangers 106A and 106B and transfers heat from the discharge from low temperature compressor 108 to the collected refrigerant. As a result the refrigerant discharged by low temperature compressor 108 is cooled before reaching medium temperature compressor 110, which improves the efficiency of medium temperature compressor 110.

Several of the components of system 200 operate similarly as they did in system 100. High side heat exchanger 102 removes heat from a refrigerant. Flash tank 104 stores refrigerant. Low temperature low side heat exchangers 106A and 106B use refrigerant from flash tank 104 to cool spaces proximate low temperature low side heat exchangers 106A and 106B. Low temperature compressor 108 compresses refrigerant. Medium temperature compressor 110 compresses refrigerant from low temperature compressor 108 and flash tank 104. Oil separator 112 separates an oil from refrigerant. Valve 114 controls a flow of flash gas from flash tank 104 to medium temperature compressor 110.

As discussed above, the lack of medium temperature low side heat exchangers in many cooling systems may cause medium temperature compressor 110 to compress mostly refrigerant from low temperature compressor 108. Because this refrigerant is very hot, the efficiency of medium temperature compressor 110 suffers. System 200 improves the efficiency in medium temperature compressor 110 over other cooling systems by flooding low temperature low side heat exchangers 106A and 106B and by transferring heat from the discharge of low temperature compressor 108 to the refrigerant discharged by low temperature low side heat exchangers 106A and 106B, in certain embodiments.

Low temperature low side heat exchangers 106A and 106B are flooded in system 200. Generally, to flood low temperature low side heat exchangers 106A and 106B, more refrigerant than low temperature low side heat exchangers 106A and 106B can evaporate is directed to low temperature low side heat exchangers 106A and 106B. As a result, not all of the refrigerant that is directed to low temperature low side heat exchangers 106A and 106B is evaporated within low temperature low side heat exchangers 106A and 106B. As a result, the refrigerant discharges by low temperature low side heat exchangers 106A and 106B will include a vapor portion and a liquid portion. The discharged refrigerant is directed to accumulator 202.

Accumulator 202 collects the refrigerant discharged by low temperature low side heat exchangers 106A and 106B. Refrigerant may enter accumulator 202 through inlet 204. Inlet 204 may be a pipe or a tube that directs refrigerant into the body of accumulator 202. Inlet 204 may be positioned at a top surface of accumulator 202. Because the refrigerant discharged from low temperature low side heat exchangers 106A and 106B include both a liquid portion and a vapor portion, the refrigerant entering accumulator 202 also includes a liquid portion 214 and a vapor portion 216. Liquid portion 214 drops to and collects at the bottom of accumulator 202. Vapor portion 216 collects in the space above liquid portion 214. As more refrigerant is collected by accumulator 202, a level 218 of liquid portion 214 in accumulator 202 rises.

Accumulator 202 discharges refrigerant through outlet 206. Outlet 206 may be a pipe or a tube that directs refrigerant out of accumulator 202 and to low temperature compressor 108. Outlet 206 may have a U-shaped curvature that exits accumulator 202 at a top surface of accumulator 202. As a result, a first end of outlet 206 is contained within accumulator 202 at a position that is vertically higher than level 210. A second end of outlet 206 is outside accumulator 202. Vapor portion 216 enters the first end of outlet 206 and is carried out of accumulator 202 through the second end of outlet 206. Due to the shape of outlet 206, vapor portion 216 of refrigerant in accumulator 202 may enter outlet 206. Liquid portion 214 of refrigerant in accumulator 202 may not enter outlet 206 unless liquid portion 214 rises above the point at which vapor portion 216 enters outlet 206. Certain safeguards discussed below may be implemented to control level 218 to prevent liquid portion 214 from entering outlet 206. As a result, liquid refrigerant is prevented from entering low temperature compressor 108, which protects low temperature compressor 108 from liquid slugging.

Discharge from low temperature compressor 108 may be directed into accumulator 202 via piping 208. Piping 208 carries refrigerant from low temperature compressor 108 into accumulator 202. Piping 208 may coil or wind within accumulator 202 to increase the heat transfer area as the refrigerant from low temperature compressor 108 flows through accumulator 202. Piping 208 then directs the refrigerant to medium temperature compressor 110.

As discussed previously, the refrigerant from low temperature compressor 108 has a high temperature. As that refrigerant flows through accumulator 202, the heat in that refrigerant is transferred to the refrigerant collected in accumulator 202. The heat may be transferred to both the liquid portion 214 and the vapor portion 216. As a result, the refrigerant discharged by low temperature compressor 108 is cooled before that refrigerant is directed to medium temperature compressor 110. As liquid portion 214 absorbs heat from the refrigerant in piping 208, liquid portion 214 may evaporate. The evaporated refrigerant may then drift upwards in accumulator 202 and enter outlet 206. As a result, the level 218 of liquid portion 214 may drop as heat from the discharge of low temperature compressor 108 is transferred to liquid portion 214.

Sight glasses 212 are coupled to accumulator 202. Sight glasses 212 allow visibility into the interior of accumulator 202. Importantly, through sight glasses 212, an operator can see the level 218 of liquid portion 214. If the level 218 is too high, the operator may determine that more heat should be transferred to liquid portion 214 to evaporate liquid portion 214. If the level 218 is too low, the operator may determine that less heat should be transferred to liquid portion 214 to allow more liquid refrigerant to collect in accumulator 202.

Valve 210 controls a flow of refrigerant from low temperature compressor 108 to medium compressor 110. Generally, valve 210 allows refrigerant from low temperature compressor 108 to bypass accumulator 202. When valve 210 is closed, the refrigerant from low temperature compressor 108 flows through accumulator 202 to medium temperature compressor 110. When valve 210 is partially open or fully open, some or all of the refrigerant discharged by low temperature compressor 108 bypasses accumulator 202 enroute to medium temperature compressor 110. Valve 210 may open or close based on the level 218 of liquid portion 214 in accumulator 202. For example, when level 218 is high, valve 210 may close to direct more refrigerant from low temperature compressor 108 to accumulator 202 to increase heat transfer. When level 218 is low, valve 210 may open to allow refrigerant from low temperature compressor 108 to bypass accumulator 202, so that additional liquid refrigerant can collect in accumulator 202.

Sensor 220 may detect level 218 of liquid portion 214 in accumulator 202. In certain embodiments, sensor 220 may determine when level 218 exceeds or falls below a threshold. If level 218 exceeds the threshold, sensor 220 may cause valve 210 to close. As a result, more refrigerant from low temperature compressor 108 flows into accumulator 202, increasing heat transfer to evaporate liquid portion 214. Level 218 may then drop below the threshold. When sensor 220 detects that level 218 is below the threshold, sensor 220 may cause valve 210 to open. Some or all of the refrigerant from low temperature compressor 108 may then flow through valve 210 to medium temperature compressor 110, bypassing accumulator 202. As a result, less heat transfer occurs within accumulator 202 and level 218 may increase. In this manner, the amount of liquid portion 214 in accumulator 202 may be controlled.

FIG. 3 is a flowchart illustrating a method 300 of operating the example cooling system 200 of FIG. 2. Generally, one or more components of system 200 perform the steps of method 300. In particular embodiments, by performing method 300, the efficiency of medium temperature compressor 110 is improved.

In step 302, flash tank 104 stores a refrigerant. Low temperature low side heat exchanger 106A uses the refrigerant to cool a space in step 304. Low temperature low side heat exchanger 106B uses the refrigerant to cool a space in step 306. Both low temperature low side heat exchangers 106A and 106B are flooded such that the discharge of low temperature low side heat exchangers 106A and 106B includes both a liquid portion and a vapor portion.

Accumulator 202 collects the refrigerant from low temperature low side heat exchangers 106A and 106B in step 308. The collected refrigerant includes both a liquid portion 214 and a vapor portion 216. Liquid portion 214 collects at the bottom of accumulator 202. Vapor portion 216 is discharged from accumulator 202. Low temperature compressor 108 compresses the refrigerant from accumulator 202. The compressed refrigerant may then be directed back to accumulator 202, so that heat within the compressed refrigerant may be transferred to the refrigerant collecting in accumulator 202. In step 312, accumulator 202 transfers heat from the refrigerant from low temperature compressor 108 to the refrigerant collecting within accumulator 202. As a result, the refrigerant from low temperature compressor 108 is cooled before reaching the medium temperature compressor 110. Additionally, liquid portion 214 may experience some evaporation, and the evaporated refrigerant may be directed out of accumulator 202.

Modifications, additions, or omissions may be made to method 300 depicted in FIG. 3. Method 300 may include more, fewer, or other steps. For example, steps may be performed in parallel or in any suitable order. While discussed as system 200 (or components thereof) performing the steps, any suitable component of systems 200 may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

This disclosure may refer to a refrigerant being from a particular component of a system (e.g., the refrigerant from the low temperature compressor, the refrigerant from the flash tank, etc.). When such terminology is used, this disclosure is not limiting the described refrigerant to being directly from the particular component. This disclosure contemplates refrigerant being from a particular component (e.g., the low temperature low side heat exchanger) even though there may be other intervening components between the particular component and the destination of the refrigerant. For example, the low temperature compressor receives a refrigerant from the low temperature low side heat exchanger even though there is an accumulator between the low temperature low side heat exchanger and the low temperature compressor.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. A system comprising:

a flash tank configured to store refrigerant;

a first low side heat exchanger configured to:

receive a first flow of the refrigerant from the flash tank and use the refrigerant to cool a first space proximate the first low side heat exchanger; and discharge the first flow of the refrigerant to an accumulator, wherein the refrigerant discharged by the first low side heat exchanger comprises a liquid portion and a gaseous portion;

a second low side heat exchanger configured to:

receive a second flow of the refrigerant from the flash tank and use the refrigerant to cool a second space proximate the second low side heat exchanger; and discharge the second flow of the refrigerant to the accumulator, wherein the refrigerant discharged by the second low side heat exchanger comprises a liquid portion and a gaseous portion;

the accumulator configured to collect the refrigerant discharged by the first and second low side heat exchangers, wherein the refrigerant in the accumulator includes a liquid portion and a vapor portion, wherein the accumulator is disposed downstream of and in series with both the first low side heat exchanger and the second low side heat exchanger with reference to flow of the refrigerant, wherein both the first low side heat exchanger and the second low side heat exchanger are disposed between the flash tank and the accumulator;

a first compressor configured to compress the refrigerant from the accumulator, the accumulator configured to transfer heat from the refrigerant discharged by the first compressor to the liquid portion and the vapor portion of the refrigerant collected by the accumulator from the first and second low side heat exchangers, wherein the accumulator comprises:

a first pipe configured to direct the vapor portion of the refrigerant in the accumulator to the first compressor;

a second pipe configured to receive the discharged refrigerant from the first compressor, wherein the second pipe is configured to transfer the discharged refrigerant from the first compressor to a second compressor in the second pipe after transferring heat to the liquid portion and the vapor portion of the refrigerant collected by the accumulator from the first and second low side heat exchangers, wherein the first pipe and the second pipe are disposed within the accumulator; and a valve disposed between the first compressor and the second compressor and configured to control a flow of the refrigerant discharged by the first compressor, wherein the refrigerant discharged by the first compressor flows through the valve and to the second compressor bypassing the accumulator when the valve is open, and the refrigerant discharged by the first compressor flows through the accumulator and to the second compressor when the valve is closed.

2. The system of claim 1, wherein the heat evaporates a portion of the refrigerant collected by the accumulator, the evaporated portion flows from the accumulator to the first compressor.

3. The system of claim 1, further comprising the second compressor configured to compress the refrigerant discharged by the first compressor.

4. The system of claim 1, further comprising a level sensor coupled to the accumulator, the level sensor configured to detect a level of the refrigerant collected by the accumulator, the valve configured to close when the level sensor detects that the level of the refrigerant collected by the accumulator exceeds a threshold.

5. The system of claim 1, the accumulator further comprising a sight glass that allows a level of the refrigerant collected by the accumulator to be visible external to the accumulator.

6. The system of claim 1, further comprising a flash gas bypass valve configured to control a flow of the refrigerant from the flash tank to the second compressor.

7. A method comprising:

storing, by a flash tank, refrigerant;

receiving, by a first low side heat exchanger, a first flow of the refrigerant from the flash tank to cool a first space proximate the first low side heat exchanger;

discharging the first flow of the refrigerant from the first low side heat exchanger to an accumulator, wherein the refrigerant discharged by the first low side heat exchanger comprises a liquid portion and a gaseous portion;

receiving, by a second low side heat exchanger, a second flow of the refrigerant from the flash tank to cool a second space proximate the second low side heat exchanger;

discharging the second flow of the refrigerant from the second low side heat exchanger to the accumulator, wherein the refrigerant discharged by the second low side heat exchanger comprises a liquid portion and a gaseous portion;

collecting, by the accumulator, the refrigerant discharged by the first and second low side heat exchangers, wherein the accumulator is disposed downstream of and in series with both the first low side heat exchanger and the second low side heat exchanger with reference to flow of the refrigerant, wherein both the first low side heat exchanger and the second low side heat exchanger are disposed between the flash tank and the accumulator;

compressing, by a first compressor, the refrigerant from the accumulator, wherein the accumulator comprises a first pipe disposed within the accumulator that is configured to direct the gaseous portion of the refrigerant in the accumulator to the first compressor;

directing the refrigerant discharged from the first compressor to a second pine disposed within the accumulator;

transferring, by the second pipe, heat from the refrigerant discharged by the first compressor to the liquid portion and the gaseous portion of the refrigerant collected by the accumulator from the first and second low side heat exchangers;

transferring, via the second pipe, the refrigerant discharged from the first compressor to a second compressor after transferring heat to the liquid portion and the gaseous portion of the refrigerant collected by the accumulator from the first and second low side heat exchangers; and controlling, by a valve, a flow of the refrigerant discharged by the first compressor, wherein the valve is disposed between the first compressor and the second compressor, wherein the refrigerant discharged by the first compressor flows through the valve and to the second compressor bypassing the accumulator when the valve is open, and the refrigerant discharged by the first compressor flows through the accumulator and to the second compressor when the valve is closed.

8. The method of claim 7, wherein the heat evaporates a portion of the refrigerant collected by the accumulator, the evaporated portion flows from the accumulator to the first compressor.

9. The method of claim 7, further comprising compressing, by the second compressor, the refrigerant discharged by the first compressor.

10. The method of claim 7, further comprising:

detecting, by a level sensor coupled to the accumulator, a level of the refrigerant collected by the accumulator and closing the valve when the level sensor detects that the level of the refrigerant collected by the accumulator exceeds a threshold.

11. The method of claim 7, the accumulator further comprising a sight glass that allows a level of the refrigerant collected by the accumulator to be visible external to the accumulator.

12. The method of claim 7, further comprising controlling, by a flash gas bypass valve, a flow of the refrigerant from the flash tank to the second compressor.

13. A system comprising:

a first low side heat exchanger configured to:

receive a first flow of refrigerant from a flash tank and use the refrigerant to cool a first space proximate the first low side heat exchanger; and discharge the first flow of the refrigerant to an accumulator, wherein the refrigerant discharged by the first low side heat exchanger comprises a liquid portion and a gaseous portion;

a second low side heat exchanger configured to:

receive a second flow of the refrigerant from the flash tank and use the refrigerant to cool a second space proximate the second low side heat exchanger; and discharge the second flow of the refrigerant to the accumulator, wherein the refrigerant discharged by the second low side heat exchanger comprises a liquid portion and a gaseous portion;

the accumulator configured to collect the refrigerant discharged by the first and second low side heat exchangers, wherein the accumulator is disposed downstream of and in series with both the first low side heat exchanger and the second low side heat exchanger with reference to a flow of the refrigerant, wherein both the first low side heat exchanger and the second low side heat exchanger are disposed between the flash tank and the accumulator;

a first compressor configured to compress the refrigerant from the accumulator, the accumulator configured to transfer heat from the refrigerant discharged by the first compressor to the refrigerant collected by the accumulator from the first and second low side heat exchangers, wherein the accumulator comprises a first pipe configured to direct the vapor portion of the refrigerant in the accumulator to the first compressor;

a second pipe configured to receive the discharged refrigerant from the first compressor wherein the second pipe is configured to transfer the discharged refrigerant from the first compressor to a second compressor in the second pipe after transferring heat to the refrigerant collected by the accumulator from the first and second low side heat exchangers, wherein the first pipe and the second pipe are disposed within the accumulator; and a valve disposed between the first compressor and the second compressor and configured to control a flow of the refrigerant discharged by the first compressor, wherein the refrigerant discharged by the first compressor flows through the valve and to the second compressor bypassing the accumulator when the valve is open, and the refrigerant discharged by the first compressor flows through the accumulator and to the second compressor when the valve is closed.

14. The system of claim 13, wherein the heat evaporates a portion of the refrigerant collected by the accumulator, the evaporated portion flows from the accumulator to the first compressor.

15. The system of claim 13, further comprising the second compressor configured to compress the refrigerant discharged by the first compressor.

16. The system of claim 13, further comprising a level sensor coupled to the accumulator, the level sensor configured to detect a level of the refrigerant collected by the accumulator, the valve configured to close when the level sensor detects that the level of the refrigerant collected by the accumulator exceeds a threshold.

17. The system of claim 13, the accumulator further comprising a sight glass that allows a level of the refrigerant collected by the accumulator to be visible external to the accumulator.

* * * * *